US011121470B2

(12) United States Patent
Itou et al.

(10) Patent No.: US 11,121,470 B2
(45) Date of Patent: Sep. 14, 2021

(54) FILM ANTENNA

(71) Applicant: Yazaki Corporation, Tokyo (JP)

(72) Inventors: Eita Itou, Shizuoka (JP); Kunihiko Yamada, Shizuoka (JP); Kenji Matsushita, Kanagawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/819,711

(22) Filed: Mar. 16, 2020

(65) Prior Publication Data

US 2020/0220271 A1 Jul. 9, 2020

Related U.S. Application Data

(63) Continuation of application No. PCT/JP2018/020926, filed on May 31, 2018.

(30) Foreign Application Priority Data

Oct. 17, 2017 (JP) ..... JP2017-200836

(51) Int. Cl.

| | |
|---|---|
| ***H01Q 9/04*** | (2006.01) |
| ***H01Q 1/48*** | (2006.01) |
| ***H01Q 7/00*** | (2006.01) |
| ***H01Q 9/40*** | (2006.01) |

(52) U.S. Cl.

CPC ..... *H01Q 9/045* (2013.01); *H01Q 1/48* (2013.01); *H01Q 7/00* (2013.01); *H01Q 9/40* (2013.01)

(58) Field of Classification Search

CPC .. H01Q 1/22; H01Q 1/38; H01Q 1/48; H01Q 5/307; H01Q 9/0428; H01Q 9/045; H01Q 9/40

See application file for complete search history.

(56) References Cited

U.S. PATENT DOCUMENTS

2005/0052334 A1* 3/2005 Ogino ..... H01Q 9/30 343/866
2005/0130389 A1* 6/2005 Yamazaki ..... H01L 27/1214 438/455
2006/0077104 A1* 4/2006 Usui ..... H01Q 1/38 343/702

(Continued)

FOREIGN PATENT DOCUMENTS

JP 7-131234 A 5/1995
JP 2006-013696 A 1/2006

(Continued)

OTHER PUBLICATIONS

Notification of Reasons for Refusal of Japanese Application No. 2017-200836 dated Dec. 24, 2019.

(Continued)

*Primary Examiner* — Tung X Le

(74) *Attorney, Agent, or Firm* — Sughrue Mion, PLLC

(57) ABSTRACT

A film antenna includes a sheet-shaped resin film; an antenna pattern; a power feed pattern; and a ground pattern. The antenna pattern is formed on a front face of the resin film and used for transmission and reception of a signal. The power feed pattern is formed on the front face of the resin film, connected with the antenna pattern, and used for transmission of an electric signal. The ground pattern is electrically conductive and formed on a back face of the resin film.

7 Claims, 4 Drawing Sheets

(56) References Cited

U.S. PATENT DOCUMENTS

| | | | | |
|---|---|---|---|---|
| 2008/0055183 | A1* | 3/2008 | Yuba | H01Q 9/28 343/872 |
| 2014/0132466 | A1* | 5/2014 | Inoue | H01Q 13/085 343/767 |
| 2017/0279181 | A1* | 9/2017 | Niihara | H01Q 1/20 |
| 2019/0051968 | A1* | 2/2019 | Tayama | H01Q 5/371 |

FOREIGN PATENT DOCUMENTS

| | | | |
|---|---|---|---|
| JP | 2008-193299 | A | 8/2008 |
| JP | 2011-091557 | A | 5/2011 |
| JP | 2012-253700 | A | 12/2012 |

OTHER PUBLICATIONS

International Search Report for PCT/JP2018/020926 dated Aug. 7, 2018 [PCT/ISA/210].

* cited by examiner

FILM ANTENNA

CROSS-REFERENCE TO RELATED APPLICATION(S)

This application is a continuation application of International Application PCT/JP2018/020926, filed on May 31, 2018, and designating the U.S., the entire contents of which are incorporated herein by reference.

BACKGROUND OF THE INVENTION

1. Field of the Invention

The present invention relates to a film antenna.

2. Description of the Related Art

Japanese Patent Application Laid-open No. 2006-13696, for example, discloses a film antenna that includes an insulated transparent film having flexibility, a circular polarization antenna formed on the transparent film, and a power feed terminal that feeds electricity to the circular polarization antenna.

The film antenna disclosed in Japanese Patent Application Laid-open No. 2006-13696 may, for example, be noteworthy for a thin and flexible configuration to achieve mountability through the formation of the circular polarization antenna (balanced antenna) on the transparent film. The film antenna, however, still needs further improvement in that an unbalanced antenna is also required to be formed on the transparent film.

SUMMARY OF THE INVENTION

The present invention has been made in view of the foregoing situation and it is an object of the present invention to provide a film antenna that enables formation of any antenna portion, while achieving mountability.

In order to solve the problem and achieve the above objection, a film antenna according to one aspect of the present invention includes a sheet-shaped resin film; an antenna pattern, formed on a face on a first side of the resin film, for transmission and reception of a signal; a power feed pattern, formed on the face on the first side of the resin film and connected with the antenna pattern, for transmission of an electric signal; and an electrically conductive ground pattern formed on a face on a second side of the resin film wherein the resin film folded back onto a side of the face on the first side up to a position at which the antenna pattern faces the ground pattern, and the antenna pattern and the ground pattern constitute an antenna portion being able to transmit and receive the signal.

According to another aspect of the present invention, in the film antenna, it is preferable that the antenna pattern includes a first unbalanced antenna pattern, the ground pattern includes a first ground pattern on which the first unbalanced antenna pattern is entirely superimposed via the resin film, and the first unbalanced antenna pattern and the first ground pattern constitute a first antenna portion being able to transmit and receive the signal.

According to still another aspect of the present invention, in the film antenna, it is preferable that the film antenna further includes a superimposed portion, in which the antenna pattern is superimposed on the ground pattern via the resin film, wherein the antenna pattern includes a second unbalanced antenna pattern, the ground pattern includes a second ground pattern, the superimposed portion is capacitively coupled by a part of the second unbalanced antenna pattern being superimposed on the second ground pattern via the resin film, the resin film is folded back, with the superimposed portion as a starting point of folding, onto a side of the face on the first side up to a position at which the second unbalanced antenna pattern faces the second ground pattern, and the second unbalanced antenna pattern and the second ground pattern constitute a second antenna portion being able to transmit and receive the signal.

According to still another aspect of the present invention, in the film antenna, it is preferable that the antenna pattern includes a balanced antenna pattern, the resin film includes a non-grounding portion, in which the balanced antenna pattern is not superimposed on the ground pattern via the resin film, and the balanced antenna pattern and the non-grounding portion constitute a third antenna portion being able to transmit and receive the signal.

According to still another aspect of the present invention, in the film antenna, it is preferable that the ground pattern includes a third ground pattern that is superimposed on the power feed pattern via the resin film, and the power feed pattern and the third ground pattern constitute a power feed line that can transmit the electric signal.

According to still another aspect of the present invention, in the film antenna, it is preferable that the antenna pattern includes the balanced antenna pattern and the unbalanced antenna pattern on the face on the first side of the single resin film, and the ground pattern acts electrically on the unbalanced antenna pattern and does not act electrically on the balanced antenna pattern.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following details, with reference to the accompanying drawings, an embodiment for carrying out the invention. The following descriptions are not to be considered limiting. The elements described hereunder include those that can be easily conceived by those skilled in the art and those that are substantially identical to each other. Furthermore, the configurations described hereunder may be combined with each other as appropriate. Various omissions, substitutions, and changes in the form of the configurations described herein may be made without departing from the spirit of the invention.

EMBODIMENT

The following describes a film antenna 1 according to an embodiment. The film antenna 1 performs at least either one of transmission and reception of signals. The film antenna 1 is disposed in, for example, a vehicle and mounted in a dielectric body in, for example, a windshield or an instrument panel of the vehicle, inside a roof of the vehicle, or in a side surface of a router housing. The film antenna 1 receives signals transmitted from, for example, a global positioning system (GPS), an electronic toll collection system (ETC) (registered trademark), a digital broadcasting system, a cellular phone base station, and an intelligent transport system (ITS). The film antenna 1 is connected with a reception terminal, not illustrated, via a cable and outputs a received signal to the reception terminal via the cable. The present embodiment will be described as relating to an example, in which the film antenna 1 includes a plurality of types of antenna portions formed on a single resin film 10. The following details the film antenna 1.

It is noted that the film antenna 1 has a width direction in which a monopole antenna portion B and a monopole antenna portion C, which will be described later, are juxtaposed. A depth direction is orthogonal to a planar portion of the resin film 10. The depth direction is referred to also as a thickness direction of the resin film 10. The width direction is substantially orthogonal to the depth direction.

Figure 1:
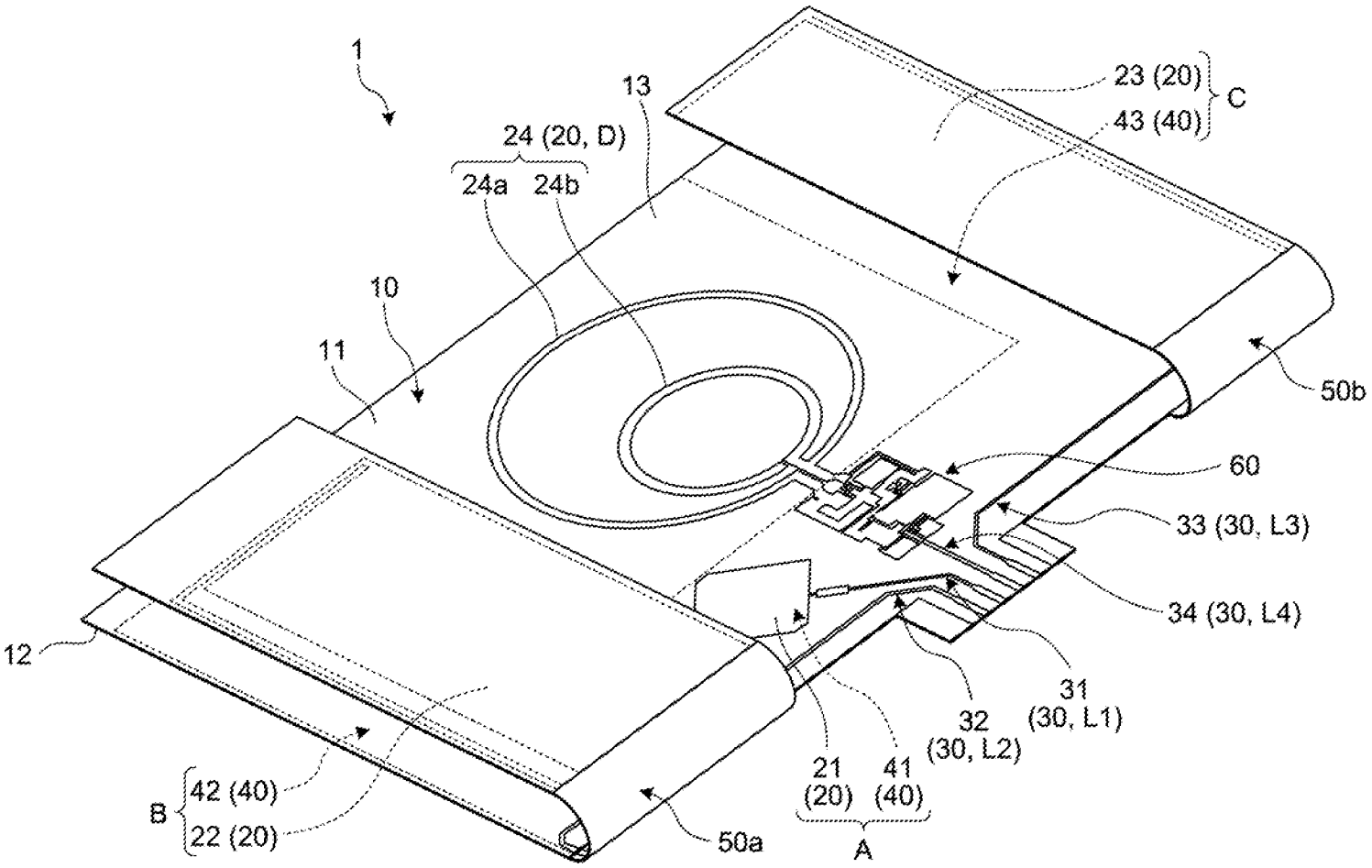
FIG. 1 is a perspective view of a configuration example of a film antenna according to an embodiment.
Figure 2:
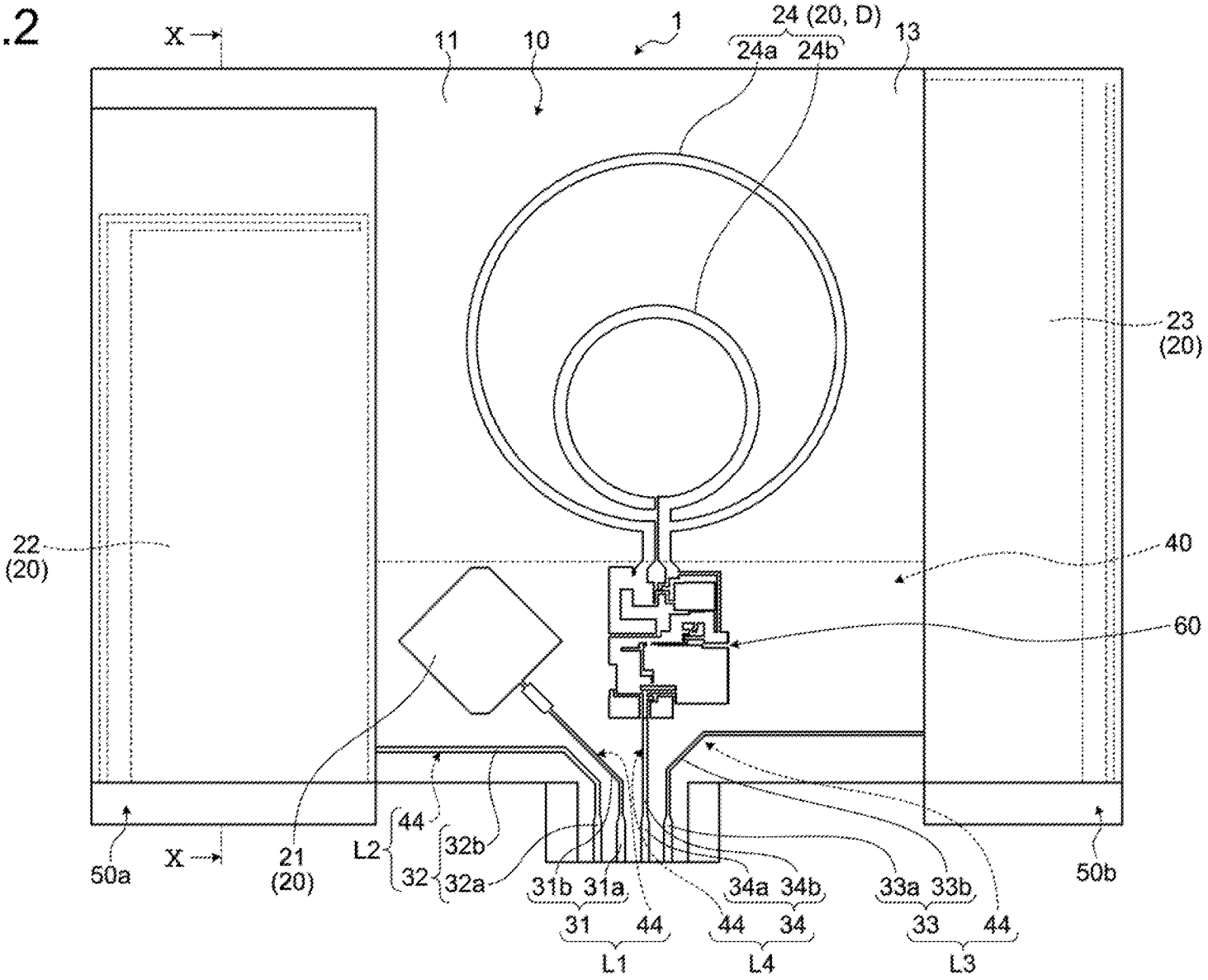
FIG. 2 is a plan view of the configuration example of the film antenna according to the embodiment.
Figure 3:
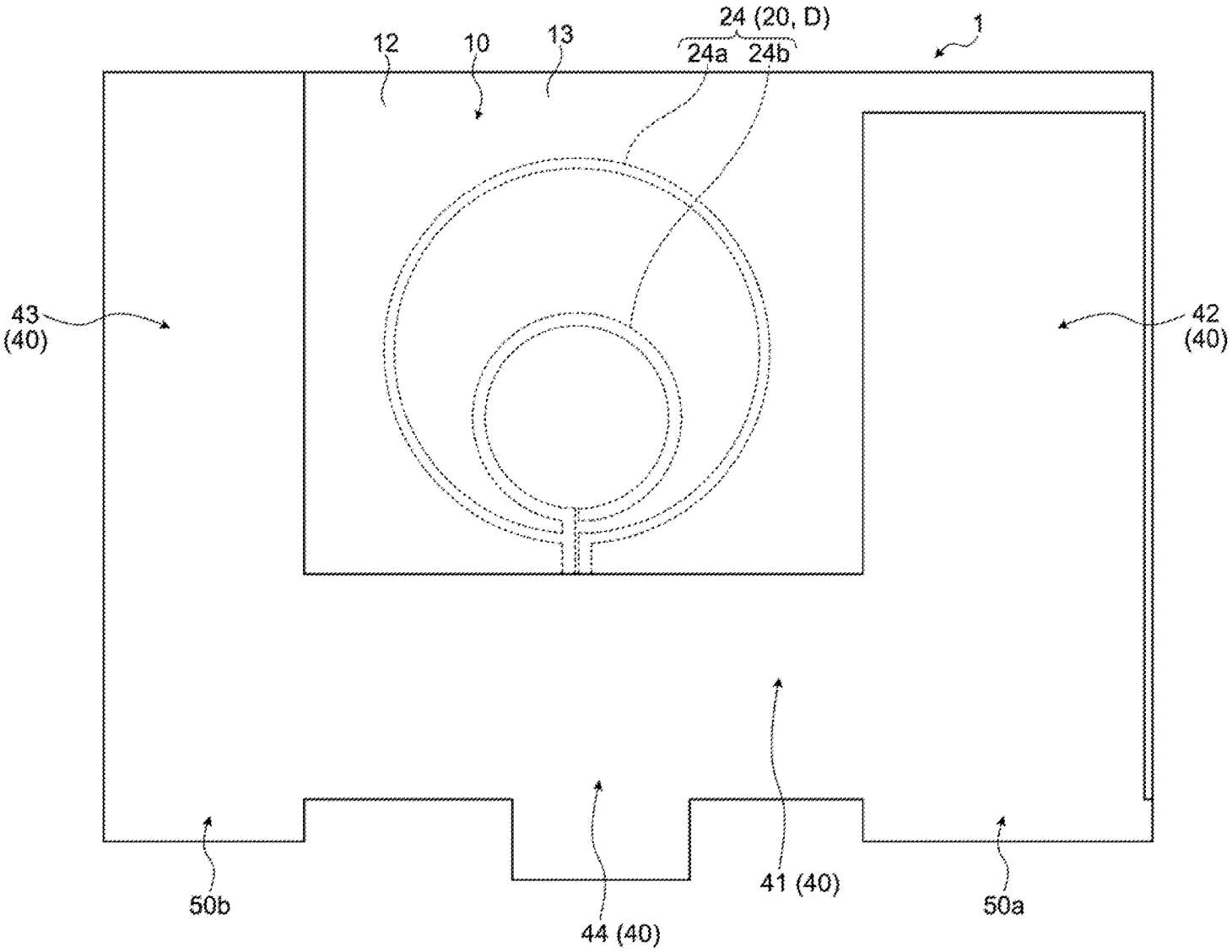
FIG. 3 is a bottom view of the configuration example of the film antenna according to the embodiment.

The film antenna 1 includes, as illustrated in FIGS. 1, 2, and 3, the resin film 10, an antenna pattern 20, a power feed pattern 30, a ground pattern 40, superimposed portions 50*a* and 50*b*, and an amplifier circuit 60.

The resin film 10 is a transparent film formed of, for example, an insulating resin. The resin film 10 is formed into a single sheet shape and has a part folded back. The resin film 10 has a film thickness of, for example, about 250 μm. The resin film 10 has a front face 11 on a first side in the thickness direction and a back face 12 on a second side in the thickness direction. The front face 11 constitutes a surface on the first side. The back face 12 constitutes a surface on the second side. The resin film 10 includes a non-grounding portion 13, in which a loop antenna pattern 24, which will be described later, is not superimposed on the ground pattern 40 via the resin film 10.

The antenna pattern 20 is an electrically conductive pattern used for transmission and reception of signals. The antenna pattern 20 is formed on the front face 11 of the resin film 10. The antenna pattern 20 is formed, for example, by a silver paste or another conductor being printed. The printing of the silver paste or another conductor is, however, illustrative only and not limiting and the antenna pattern 20 may be formed of, for example, an electrically conductive ink or a conductive thin film. The antenna pattern 20 includes a balanced antenna pattern and an unbalanced antenna pattern on the front face 11 of the single resin film 10. The term "balanced antenna", as used herein, refers to an antenna in which charge is symmetrically distributed over the antenna pattern and that requires no ground pattern 40. The term "unbalanced antenna", as used herein, refers to an antenna in which charge is asymmetrically distributed over the antenna pattern and that requires the ground pattern 40. The antenna pattern 20 includes, for example, a patch antenna pattern 21 as a first unbalanced antenna pattern, monopole antenna patterns 22 and 23 as second unbalanced antenna patterns, and the loop antenna pattern 24 as the balanced antenna pattern. The patch antenna pattern 21, the monopole antenna patterns 22 and 23, and the loop antenna pattern 24 are disposed such that antenna patterns receiving signals at frequencies close to each other are spaced apart from each other. The foregoing disposition enables each of the patch antenna pattern 21, the monopole antenna patterns 22 and 23, and the loop antenna pattern 24 to prevent signals from interfering with each other. For example, the monopole antenna pattern 22 is formed on the first side in the width direction of the resin film 10 and the monopole antenna pattern 23 is formed on the second side in the width direction of the resin film 10. The patch antenna pattern 21 and the loop antenna pattern 24 are formed between the monopole antenna pattern 22 and the monopole antenna pattern 23 and located substantially at a central portion in the width direction of the resin film 10.

The power feed pattern 30 is an electrically conductive pattern used for transmission of electric signals. The power feed pattern 30 is formed on the front face 11 of the resin film 10. The power feed pattern 30 is formed, for example, by a silver paste or another conductor being printed. The printing of the silver paste or another conductor is, however, illustrative only and not limiting and the power feed pattern 30 may be formed of, for example, an electrically conductive ink or a conductive thin film. The power feed pattern 30 includes a first power feed pattern 31, a second power feed pattern 32, a third power feed pattern 33, and a fourth power feed pattern 34.

The ground pattern 40 is an electrically conductive pattern acting electrically on at least either one of the antenna pattern 20 and the power feed pattern 30. The ground pattern 40 is formed on the back face 12 of the resin film 10. The ground pattern 40 is formed, for example, by a silver paste or another conductor being printed. The printing of the silver paste or another conductor is, however, illustrative only and not limiting and the ground pattern 40 may be formed of, for example, an electrically conductive ink or a conductive thin film. The ground pattern 40 includes a ground conductor pattern 41 as a first ground pattern, a monopole ground pattern 42 as a second ground pattern, a monopole ground pattern 43 as a second ground pattern, and a power feed ground pattern 44 as a third ground pattern. The ground conductor pattern 41, the monopole ground pattern 42, the monopole ground pattern 43, and the power feed ground pattern 44 are electrically connected with each other.

The patch antenna pattern 21 and the ground conductor pattern 41 constitute a patch antenna portion A as a first antenna portion that can transmit and receive signals. The patch antenna portion A represents an unbalanced antenna including the patch antenna pattern 21 and the ground conductor pattern 41 disposed via the resin film 10. The patch antenna pattern 21 is formed of, for example, a silver paste or another conductor on the front face 11 of the resin film 10 into a rectangular shape. The patch antenna pattern 21 is electrically connected with the first power feed pattern 31. The ground conductor pattern 41 is formed of, for example, a silver paste or another conductor on the back face 12 of the resin film 10 into a shape that is greater than the patch antenna pattern 21. The ground conductor pattern 41 is entirely superimposed on the patch antenna pattern 21 via the resin film 10. Specifically, when viewed from the thickness direction of the resin film 10, the ground conductor pattern 41 includes a portion that is at least generally superimposed on the patch antenna pattern 21. The patch antenna portion A includes the patch antenna pattern 21 and the ground conductor pattern 41 formed via the resin film 10 as a dielectric and constitutes a resonance circuit that resonates at a predetermined frequency. When viewed from the thickness direction of the resin film 10, for example, the patch antenna portion A is disposed between the monopole antenna portion B and the monopole antenna portion C. The patch antenna portion A outputs a received signal to a microstrip line portion L1, which will be described later.

Figure 4:
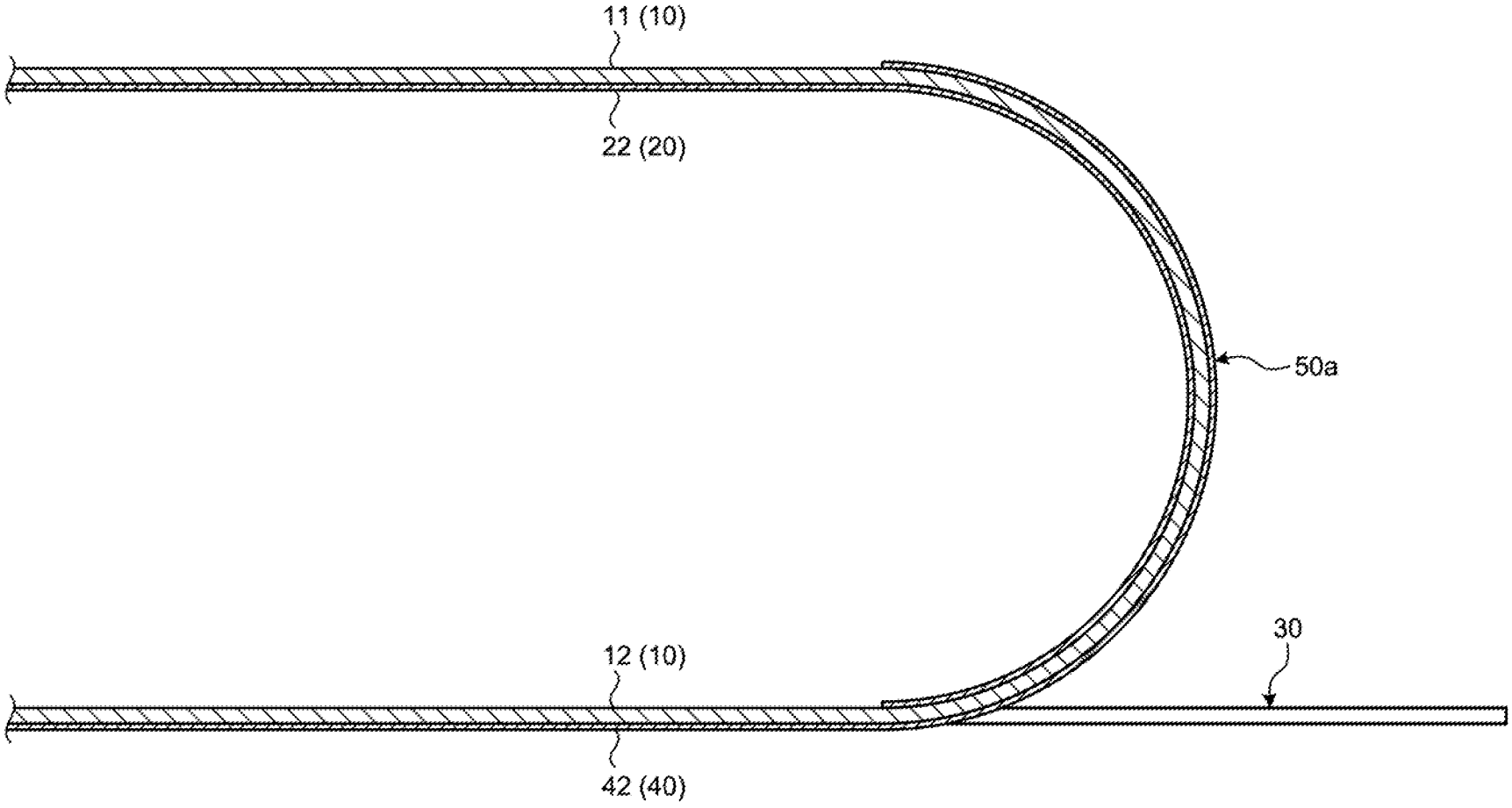
FIG. 4 is a partial cross-sectional view taken along X-X in FIG. 2.

The monopole antenna pattern 22 and the monopole ground pattern 42 constitute the monopole antenna portion B as a second antenna portion that can transmit and receive signals. The monopole antenna portion B represents an unbalanced antenna electrically connecting the monopole antenna pattern 22 with the monopole ground pattern 42. The monopole antenna pattern 22 is formed of, for example, a silver paste or another conductor on the front face 11 of the resin film 10 into a substantially rectangular shape. The monopole ground pattern 42 is formed of, for example, a silver paste or another conductor on the back face 12 of the resin film 10 into a size equal to a size of the monopole antenna pattern 22, which, however, is illustrative only and not limiting. It is here noted that the film antenna 1 includes the superimposed portion 50*a*, in which the monopole antenna pattern 22 is superimposed on the monopole ground pattern 42 via the resin film 10. The superimposed portion 50*a* is capacitively coupled by a part of the monopole antenna pattern 22 being superimposed on the monopole ground pattern 42 via the resin film 10 as illustrated in FIG. 4. The monopole antenna pattern 22 is electrically connected with the second power feed pattern 32. The resin film 10 is folded back, with the superimposed portion 50*a* as a starting point of folding, onto the side of the front face 11 up to a position at which the monopole antenna pattern 22 faces the monopole ground pattern 42. In the resin film 10, the monopole antenna pattern 22 faces the monopole ground pattern 42 in the depth direction with a gap interposed therebetween. A dielectric such as a foaming material (for example, a dielectric having a dielectric constant of 1.3 or smaller) is interposed in this gap in the resin film 10. With the foregoing configuration, the monopole antenna pattern 22 and the monopole ground pattern 42 constitute the monopole antenna portion B. The monopole antenna portion B, including the monopole antenna pattern 22 capacitively coupled with the monopole ground pattern 42, constitutes a resonance circuit that resonates at a predetermined frequency. A height in the depth direction is generated in the monopole antenna portion B by the dielectric, such as a foaming material, disposed in the gap. The monopole antenna portion B simulatively forms a folded monopole antenna with this height in the depth direction, to thereby be able to receive vertically polarized waves transmitted from the cellular phone base station or the ITS. The monopole antenna portion B improves gain more with greater heights in the depth direction. The monopole antenna portion B, for example, outputs the received signal to a microstrip line portion L2, which will be described later.

The monopole antenna pattern 23 and the monopole ground pattern 43 constitute the monopole antenna portion C as a second antenna portion. The monopole antenna portion C is configured equally to the monopole antenna portion B described above. Specifically, the monopole antenna portion C represents an unbalanced antenna electrically connecting the monopole antenna pattern 23 with the monopole ground pattern 43. The monopole antenna pattern 23 is formed of, for example, a silver paste or another conductor on the front face 11 of the resin film 10 into a substantially rectangular shape. The monopole ground pattern 43 is formed of, for example, a silver paste or another conductor on the back face 12 of the resin film 10 into a size equal to a size of the monopole antenna pattern 23, which, however, is illustrative only and not limiting. It is here noted that the film antenna 1 includes the superimposed portion 50*b*, in which the monopole antenna pattern 23 is superimposed on the monopole ground pattern 43 via the resin film 10. The superimposed portion 50*b* is capacitively coupled by a part of the monopole antenna pattern 23 being superimposed on the monopole ground pattern 43 via the resin film 10. The monopole antenna pattern 23 is electrically connected with the third power feed pattern 33. The resin film 10 is folded back, with the superimposed portion 50*b* as a starting point of folding, onto the side of the front face 11 up to a position at which the monopole antenna pattern 23 faces the monopole ground pattern 43. In the resin film 10, the monopole antenna pattern 23 faces the monopole ground pattern 43 in the depth direction with a gap interposed therebetween. A dielectric such as a foaming material (for example, a dielectric having a dielectric constant of 1.3 or smaller) is interposed in this gap in the resin film 10. With the foregoing configuration, the monopole antenna pattern 23 and the monopole ground pattern 43 constitute the monopole antenna portion C. The monopole antenna portion C, including the monopole antenna pattern 23 capacitively coupled with the monopole ground pattern 43, constitutes a resonance circuit that resonates at a predetermined frequency. A height in the depth direction is generated in the monopole antenna portion C by the dielectric, such as a foaming material, disposed in the gap. The monopole antenna portion C simulatively forms a folded monopole antenna with this height in the depth direction, to thereby be able to receive vertically polarized waves transmitted from the cellular phone base station or the ITS. The monopole antenna portion C improves gain more with greater heights in the depth direction. The monopole antenna portion C, for example, outputs the received signal to a microstrip line portion L3, which will be described later.

The loop antenna pattern 24 and the non-grounding portion 13 constitute a loop antenna portion D as a third antenna portion that can transmit and receive signals. The loop antenna portion D is a balanced antenna including the loop antenna pattern 24, which is formed on the front face 11 of the resin film 10. The loop antenna pattern 24 is formed of, for example, a silver paste or another conductor into an annular shape on the front face 11 of the resin film 10. The non-grounding portion 13 represents a portion in which the loop antenna pattern 24 is not superimposed on the ground pattern 40 via the resin film 10 as illustrated in FIG. 3. The loop antenna pattern 24 includes, for example, an outer peripheral conductor portion 24*a* and an inner peripheral conductor portion 24*b*. The outer peripheral conductor portion 24*a* is formed into an annular shape and receives, for example, right-handed circularly polarized waves. The inner peripheral conductor portion 24*b* is formed into an annular shape inside the outer peripheral conductor portion 24*a*. The inner peripheral conductor portion 24*b*, for example, prevents reception of left-handed circularly polarized waves. The outer peripheral conductor portion 24*a* is connected with the amplifier circuit 60. The amplifier circuit 60 is formed near the outer peripheral conductor portion 24*a* and amplifies signals received by the outer peripheral conductor portion 24*a*. The amplifier circuit 60 is connected with the fourth power feed pattern 34 and outputs the amplified signal to a microstrip line portion L4.

The power feed patterns 31 to 34 and the power feed ground patterns 44 constitute the respective microstrip line portions L1 to L4, which each serve as a power feed line capable of transmitting electric signals. The first power feed pattern 31 is formed of, for example, a silver paste or another conductor on the front face 11 of the resin film 10. The first power feed pattern 31 includes, as illustrated in FIG. 2, a land portion 31*a* and a power feed line portion 31*b*. The land portion 31*a* is connected with a connector of a cable of a reception terminal. The power feed line portion 31*b* electrically connects the land portion 31*a* with the patch antenna pattern 21. The power feed line portion 31*b* is formed linearly and has a first end connected with the land portion 31*a* and a second end connected with the patch antenna pattern 21. The power feed ground pattern 44 is formed of, for example, a silver paste or another conductor on the back face 12 of the resin film 10 and includes a range over which the power feed ground pattern 44 is superimposed on the first power feed pattern 31. The first power feed pattern 31 and the power feed ground pattern 44 constitute the microstrip line portion L1. The microstrip line portion L1 has impedance established by the dielectric constant of the resin film 10, a thickness of the resin film 10, a pattern width of the power feed line portion 31*b*, and the power feed ground pattern 44. The microstrip line portion L1 transmits electromagnetic waves with an electric field expanding from the first power feed pattern 31 toward the power feed ground pattern 44 and a magnetic field surrounding the first power feed pattern 31.

The second power feed pattern 32 is formed of, for example, a silver paste or another conductor on the front face 11 of the resin film 10. The second power feed pattern 32 includes a land portion 32*a* and a power feed line portion 32*b*. The land portion 32*a* is connected with a connector of a cable of a reception terminal. The power feed line portion 32*b* electrically connects the land portion 32*a* with the monopole antenna pattern 22. The power feed line portion 32*b* is formed linearly and has a first end connected with the land portion 32*a* and a second end connected with the monopole antenna pattern 22. The power feed ground pattern 44 is formed of, for example, a silver paste or another conductor on the back face 12 of the resin film 10 and includes a range over which the power feed ground pattern 44 is superimposed on the second power feed pattern 32. The second power feed pattern 32 and the power feed ground pattern 44 constitute the microstrip line portion L2. The microstrip line portion L2 has impedance established by the dielectric constant of the resin film 10, the thickness of the resin film 10, a pattern width of the power feed line portion 32*b*, and the power feed ground pattern 44. The microstrip line portion L2 transmits electromagnetic waves with an electric field expanding from the second power feed pattern 32 toward the power feed ground pattern 44 and a magnetic field surrounding the second power feed pattern 32.

The third power feed pattern 33 is formed of, for example, a silver paste or another conductor on the front face 11 of the resin film 10. The third power feed pattern 33 includes a land portion 33*a* and a power feed line portion 33*b*. The land portion 33*a* is connected with a connector of a cable of a reception terminal. The power feed line portion 33*b* electrically connects the land portion 33*a* with the monopole antenna pattern 23. The power feed line portion 33*b* is formed linearly and has a first end connected with the land portion 33*a* and a second end connected with the monopole antenna pattern 23. The power feed ground pattern 44 is formed of, for example, a silver paste or another conductor on the back face 12 of the resin film 10 and includes a range over which the power feed ground pattern 44 is superimposed on the third power feed pattern 33. The third power feed pattern 33 and the power feed ground pattern 44 constitute the microstrip line portion L3. The microstrip line portion L3 has impedance established by the dielectric constant of the resin film 10, the thickness of the resin film 10, a pattern width of the power feed line portion 33*b*, and the power feed ground pattern 44. The microstrip line portion L3 transmits electromagnetic waves with an electric field expanding from the third power feed pattern 33 toward the power feed ground pattern 44 and a magnetic field surrounding the third power feed pattern 33.

The fourth power feed pattern 34 is formed of, for example, a silver paste or another conductor on the front face 11 of the resin film 10. The fourth power feed pattern 34 includes a land portion 34*a* and a power feed line portion 34*b*. The land portion 34*a* is connected with a connector of a cable of a reception terminal. The power feed line portion 34*b* electrically connects the land portion 34*a* with the amplifier circuit 60 of the loop antenna pattern 24. The power feed line portion 34*b* is formed linearly and has a first end connected with the land portion 34*a* and a second end connected with the amplifier circuit 60 of the loop antenna pattern 24. The power feed ground pattern 44 is formed of, for example, a silver paste or another conductor on the back face 12 of the resin film 10 and includes a range over which the power feed ground pattern 44 is superimposed on the fourth power feed pattern 34. The fourth power feed pattern 34 and the power feed ground pattern 44 constitute the microstrip line portion L4. The microstrip line portion L4 has impedance established by the dielectric constant of the resin film 10, the thickness of the resin film 10, a pattern width of the power feed line portion 34*b*, and the power feed ground pattern 44. The microstrip line portion L4 transmits electromagnetic waves with an electric field expanding from the fourth power feed pattern 34 toward the power feed ground pattern 44 and a magnetic field surrounding the fourth power feed pattern 34. The land portions 31*a* to 34*a* are formed centrally at a single location to thereby be connectable with a single connector of the cable of the reception terminal.

As described above, the film antenna 1 according to the present embodiment includes the sheet-shaped resin film 10, the antenna pattern 20, the power feed pattern 30, and the ground pattern 40. The antenna pattern 20 is formed on the front face 11 of the resin film 10 and used for transmission and reception of signals. The power feed pattern 30 is formed on the front face 11 of the resin film 10, connected with the antenna pattern 20, and used for transmission of electric signals. The ground pattern 40 is electrically conductive and formed on the back face 12 of the resin film 10.

In the foregoing configuration, the film antenna 1, for example, can form the patch antenna portion A and the monopole antenna portions B and C through the ground pattern 40 electrically acting on the antenna pattern 20. The film antenna 1, for example, can form the loop antenna portion D through the ground pattern 40 not electrically acting on the antenna pattern 20. The film antenna 1, for example, can form the microstrip line portions L1 to L4 through the ground pattern 40 electrically acting on the power feed pattern 30. The film antenna 1 thus can form any one of the antenna portions A to D through the ground pattern 40 acting on at least either one of the antenna pattern 20 and the power feed pattern 30. Additionally, the film antenna 1 can transmit electric signals to each of the antenna portions A to D via the microstrip line portions L1 to L4. In addition, the film antenna 1, because of flexibility thereof achieved through the formation of each of the antenna portions A to D on the resin film 10, can be mounted in a curved portion inside, for example, the roof of the vehicle, thus achieving mountability.

In the film antenna 1, the antenna pattern 20 includes the patch antenna pattern 21. The ground pattern 40 includes the ground conductor pattern 41, which is entirely superimposed on the patch antenna pattern 21 via the resin film 10. The patch antenna pattern 21 and the ground conductor pattern 41 constitute the patch antenna portion A, which can transmit and receive signals. As such, the film antenna 1 can form any antenna portion, while achieving mountability, through the formation of the patch antenna portion A as an unbalanced antenna on the resin film 10.

The film antenna 1 includes the superimposed portions 50*a* and 50*b*, in which the antenna pattern 20 is superimposed on the ground pattern 40 via the resin film 10. The antenna pattern 20 includes the monopole antenna pattern 22. The ground pattern 40 includes the monopole ground pattern 42. The superimposed portion 50*a* is capacitively coupled by a part of the monopole antenna pattern 22 being superimposed on the monopole ground pattern 42 via the resin film 10. The resin film 10 is folded back, with the superimposed portion 50*a* as the starting point of folding, onto the side of the front face 11 up to a position at which the monopole antenna pattern 22 faces the monopole ground pattern 42. The monopole antenna pattern 22 and the monopole ground pattern 42 constitute the monopole antenna portion B, which can transmit and receive signals. Similarly, in the film antenna 1, the antenna pattern 20 includes the monopole antenna pattern 23. The ground pattern 40 includes the monopole ground pattern 43. The superimposed portion 50*b* is capacitively coupled by a part of the monopole antenna pattern 23 being superimposed on the monopole ground pattern 43 via the resin film 10. The resin film 10 is folded back, with the superimposed portion 50*b* as the starting point of folding, onto the side of the front face 11 up to a position at which the monopole antenna pattern 23 faces the monopole ground pattern 43. The monopole antenna pattern 23 and the monopole ground pattern 43 constitute the monopole antenna portion C, which can transmit and receive signals. As such, the film antenna 1 can form any antenna portion, while achieving mountability, through the formation of the monopole antenna portions B and C as the unbalanced antennas on the resin film 10. Heights in the depth direction are generated in the monopole antenna portions B and C by the dielectrics, such as a foaming material, disposed in the gaps between the monopole antenna patterns 22 and 23 and the monopole ground patterns 42 and 43. The monopole antenna portions B and C simulatively form the folded monopole antennas with the heights in the depth direction, to thereby be able to receive vertically polarized waves transmitted from the cellular phone base station or the ITS. The film antenna 1 can install, with the monopole antenna portions B and C, an antenna receiving the vertically polarized waves even in a space restricted in height in the vertical direction, such as inside the roof of the vehicle. Additionally, through the capacitive coupling between the monopole antenna patterns 22 and 23 and the monopole ground patterns 42 and 43, the film antenna 1 can simplify a manufacturing process therefor compared with a hitherto known electric connection made, for example, by a through-hole.

In the film antenna 1, the antenna pattern 20 includes the loop antenna pattern 24. The resin film 10 includes the non-grounding portion 13, in which the loop antenna pattern 24 is not superimposed on the ground pattern 40 via the resin film 10. The loop antenna pattern 24 and the non-grounding portion 13 constitute the loop antenna portion D, which can transmit and receive signals. As such, the film antenna 1 can form any antenna portion, while achieving mountability, through the formation of the loop antenna portion D as a balanced antenna on the resin film 10.

In the film antenna 1, the ground pattern 40 includes the power feed ground pattern 44, which is superimposed on the power feed pattern 30 via the resin film 10. The power feed pattern 30 and the power feed ground pattern 44 constitute the microstrip line portions L1 to L4, which can transmit electric signals. As such, through the formation of the microstrip line portions L1 to L4 on the resin film 10, the film antenna 1 can integrate a portion for feeding power to each of the antenna portions A to D at a single location when the antenna portions A to D are formed on the resin film 10. With the foregoing configuration, the film antenna 1 enables the connector of the cable of the reception terminal to be connected with the land portions 31*a* to 34*a*, which are integrated at a single location. The film antenna 1 can thereby reduce the number of connectors of the cables of the reception terminals and simplify wiring of the cables.

In the film antenna 1, the antenna pattern 20 includes the loop antenna pattern 24, the patch antenna pattern 21, and the monopole antenna patterns 22 and 23 on the front face 11 of the single resin film 10. The ground pattern 40 electrically acts on the patch antenna pattern 21 and the monopole antenna patterns 22 and 23, and does not act electrically on the loop antenna pattern 24. The foregoing configuration enables the various types of the antenna portions A to D to be integrated on the single resin film 10, so that reduction can be achieved in the space for installing each of the antenna portions A to D.

Modification

The following describes a modification of the present embodiment. While the embodiment has been described for a configuration, in which the film antenna 1 includes the patch antenna portion A, the monopole antenna portions B and C, and the loop antenna portion D, the invention is not limited thereto. The film antenna 1 may include any antenna portion other than the abovementioned antenna portions A to D. In addition, the film antenna 1 is required to include at least one of the abovementioned antenna portions A to D and any one of the microstrip line portions L1 to L4, with which the antenna portion is to be connected.

The film antenna 1, while having been described as including the loop antenna portion D, which exemplifies the balanced antenna, and the patch antenna portion A and the monopole antenna portions B and C, which exemplify the unbalanced antennas, is illustrative only, and any other antennas may represent the balanced and unbalanced antennas.

The film antenna 1 has been described as being disposed in a vehicle, which is, however, illustrative only and not limiting. The film antenna 1 may be disposed in an aircraft, watercraft, or a building.

The film antenna according to the aspect of the present embodiments enables formation of any antenna portion, while achieving mountability, through the ground pattern electrically acting on at least either one of the antenna pattern and the power feed pattern.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A film antenna comprising:

a sheet-shaped resin film;

an antenna pattern, formed on a face on a first side of the resin film, for transmission and reception of a signal;

a power feed pattern, formed on the face on the first side of the resin film and connected with the antenna pattern, for transmission of an electric signal;

an electrically conductive ground pattern formed on a face on a second side of the resin film, and a superimposed portion, in which the antenna pattern is superimposed on the ground pattern via the resin film, wherein the antenna pattern includes a first unbalanced antenna pattern, the ground pattern includes a first ground pattern on which the first unbalanced antenna pattern is entirely superimposed via the resin film, and the first unbalanced antenna pattern and the first ground pattern constitute a first antenna portion being able to transmit and receive the signal, the antenna pattern includes a second unbalanced antenna pattern, the ground pattern includes a second ground pattern, the superimposed portion is capacitively coupled by a part of the second unbalanced antenna pattern being superimposed on the second ground pattern via the resin film, the resin film is folded back, with the superimposed portion as a starting point of folding, onto the side of the face on the first side up to a position at which the second unbalanced antenna pattern faces the second ground pattern, and the second unbalanced antenna pattern and the second ground pattern constitute a second antenna portion being able to transmit and receive the signal.

2. The film antenna according to claim 1, wherein the antenna pattern includes a balanced antenna pattern, the resin film includes a non-grounding portion, in which the balanced antenna pattern is not superimposed on the ground pattern via the resin film, and the balanced antenna pattern and the non-grounding portion constitute a third antenna portion being able to transmit and receive the signal.

3. The film antenna according to claim 2, wherein the ground pattern includes a third ground pattern that is superimposed on the power feed pattern via the resin film, and the power feed pattern and the third ground pattern constitute a power feed line that is configured to transmit the electric signal.

4. The film antenna according to claim 2, wherein the antenna pattern includes the balanced antenna pattern and the unbalanced antenna pattern on the face on the first side of the single resin film, and the ground pattern acts electrically on the unbalanced antenna pattern and does not act electrically on the balanced antenna pattern.

5. The film antenna according to claim 1, wherein the ground pattern includes a third ground pattern that is superimposed on the power feed pattern via the resin film, and the power feed pattern and the third ground pattern constitute a power feed line configured to transmit the electric signal.

6. The film antenna according to claim 5, wherein the antenna pattern includes the balanced antenna pattern and the unbalanced antenna pattern on the face on the first side of the single resin film, and the ground pattern acts electrically on the unbalanced antenna pattern and does not act electrically on the balanced antenna pattern.

7. The film antenna according to claim 1, wherein the antenna pattern includes the balanced antenna pattern and the unbalanced antenna pattern on the face on the first side of the single resin film, and the ground pattern acts electrically on the unbalanced antenna pattern and does not act electrically on the balanced antenna pattern.

* * * * *